US009616477B2

(12) United States Patent
Dexter et al.

(10) Patent No.: US 9,616,477 B2
(45) Date of Patent: Apr. 11, 2017

(54) OPEN CONTAINMENT FRAME FOR ROLLER APPLIED DEEP COMPRESSION TREATMENT OF SHAFT PRODUCTS

(71) Applicant: ELLWOOD NATIONAL INVESTMENT CORP., Wilmington, DE (US)

(72) Inventors: Ronald F. Dexter, Sharon, PA (US); Marshall B. Rupert, Canfield, OH (US); Jared N. Castaldi, New Castle, PA (US); Roger L. Garrett, New Wilmington, PA (US)

(73) Assignee: Ellwood National Investment Corp., Wilmington, DE (US)

( * ) Notice: Subject to any disclaimer, the term of this patent is extended or adjusted under 35 U.S.C. 154(b) by 0 days.

(21) Appl. No.: 15/025,494

(22) PCT Filed: Oct. 15, 2013

(86) PCT No.: PCT/US2013/065032

§ 371 (c)(1),
(2) Date: Mar. 28, 2016

(87) PCT Pub. No.: WO2015/057201

PCT Pub. Date: Apr. 23, 2015

(65) Prior Publication Data

US 2016/0221055 A1 Aug. 4, 2016

(51) Int. Cl.
*B21B 31/02* (2006.01)
*B21D 3/05* (2006.01)
(Continued)

(52) U.S. Cl.
CPC ..... *B21B 31/02* (2013.01); *B21D 3/05* (2013.01); *B21D 53/84* (2013.01); *B24B 39/045* (2013.01)

(58) Field of Classification Search
CPC ..... B21B 31/02; B21B 31/08; B21D 3/02; B21D 3/05; B21D 3/06; B21D 3/08;
(Continued)

(56) References Cited

U.S. PATENT DOCUMENTS 1,646,260 A * 10/1927 Schiltz ..... B21D 3/10 72/31.03
3,213,659 A * 10/1965 Armstrong ..... B21D 3/04 219/639

(Continued)

FOREIGN PATENT DOCUMENTS

JP 2012106309 A 6/2012
SU 543508 A1 9/1977

OTHER PUBLICATIONS

International Search Report for International Application PCT/US2013/065032, Dec. 19, 2013, 2 pages, Moscow, Russia.

(Continued)

*Primary Examiner* — Edward Tolan
(74) *Attorney, Agent, or Firm* — Ference & Associates LLC

(57) ABSTRACT

An embodiment includes a suspended supporting device for roller compression treatment of rotating shaft products, comprising: a containment frame including: a main portion; and an articulating arm including an attachment for a roller cartridge; a support element attached to the main portion and providing internal stabilization to the supporting device; a mechanism providing motion to the articulating arm with respect to the main portion; and an attachment mechanism for suspending the supporting device via attachment to an external element. Other aspects are described and claimed.

15 Claims, 4 Drawing Sheets

(51) Int. Cl.
*B24B 39/04* (2006.01)
*B21D 53/84* (2006.01)

(58) Field of Classification Search
CPC ..... B21D 3/10; B21D 3/16; B24B 39/045; Y10T 29/47
See application file for complete search history.

(56) References Cited

U.S. PATENT DOCUMENTS 3,253,444 A * 5/1966 Dolan ..... B21C 37/30 72/107
4,076,136 A * 2/1978 Jenkin ..... B21D 3/04 414/433
4,624,123 A * 11/1986 Marracino ..... B21D 3/04 72/110
6,655,186 B2 * 12/2003 Pfleghar ..... B21J 15/10 100/231
7,162,903 B2 * 1/2007 Juranitch ..... B21D 3/10 72/110

OTHER PUBLICATIONS

International Preliminary Report on Patentability for International Application PCT/US2013/065032, October 22, 2015, 3 pages, Moscow, Russia.

* cited by examiner

OPEN CONTAINMENT FRAME FOR ROLLER APPLIED DEEP COMPRESSION TREATMENT OF SHAFT PRODUCTS

BACKGROUND

Inducing compressive residual stress into surfaces at critical design locations has been utilized to extend fatigue life in crankshafts and other rotating shaft applications. Methods that apply compressive residual stress have included roller (burnishing) treatments. These treatments are typically applied at journal fillet locations, which are representative of stress raisers within the shaft design. Current technologies have applied these roller (burnishing) treatments to crankshafts utilized within automotive to light-commercial engine applications.

BRIEF SUMMARY

One embodiment provides a suspended supporting device for roller compression treatment of rotating shaft products, comprising: a containment frame including: a main portion; and an articulating arm including an attachment for a roller cartridge; a support element attached to the main portion and providing internal stabilization to the supporting device; a mechanism providing motion to the articulating arm with respect to the main portion; and an attachment mechanism for suspending the supporting device via attachment to an external element.

Another embodiment provides a method for roller compression treatment of rotating shaft products using a suspended supporting device, comprising: positioning a vertically suspended containment frame about a work piece, the containment frame including: a main portion; and an articulating arm including an attachment for a roller cartridge having one or more rollers attached thereto; imparting force via one or more rollers to the work piece via a mechanism providing motion to the articulating arm with respect to the main portion; and rotating the work piece about a central axis; wherein the vertically suspended containment frame does not rotate.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

It will be readily understood that the details of the example embodiments, as generally described and illustrated in the figures herein, may be arranged and designed in a wide variety of different ways in addition to the described example embodiments. Thus, the following more detailed description of the example embodiments is not intended to limit the scope of the claims, but is merely representative of certain example embodiments.

Reference throughout this specification to "embodiment(s)" (or the like) means that a particular feature, component, step or characteristic described in connection with the embodiment is included in at least one embodiment. Thus, appearances of the phrases "according to embodiments" or "an embodiment" (or the like) in various places throughout this specification are not necessarily all referring to the same example embodiment.

Furthermore, the described features, components, steps, or characteristics may be combined in any suitable manner in different embodiments. In the following description, numerous specific details are provided to give a thorough understanding of certain example embodiments. One skilled in the relevant art will recognize, however, that aspects can be practiced without certain specific details, or with other methods, components, materials, et cetera. In other instances, well-known structures, materials, components, steps or operations are not shown or described in detail to avoid obfuscation.

In an embodiment, a roller (burnishing) method has been improved upon to be applicable to medium-speed and high-speed diesel engine applications (e.g., marine, rail and power generation engine applications). Preparation for roller treatment includes affixing of a rotatable shaft or other work piece (throughout often simply referred to as "crankshaft", etc., herein, while noting these are non-limiting examples of work pieces) into a supporting device capable of axial rotation of the crankshaft. The supporting device provides accessibility to the treatment surfaces (e.g., crankshaft journal surfaces). The supporting device also provides locations for support of the roller treatment equipment.

The illustrated example embodiments will be best understood by reference to the figures. The following description is intended only by way of example, and simply illustrates certain example embodiments.

Figure 1:
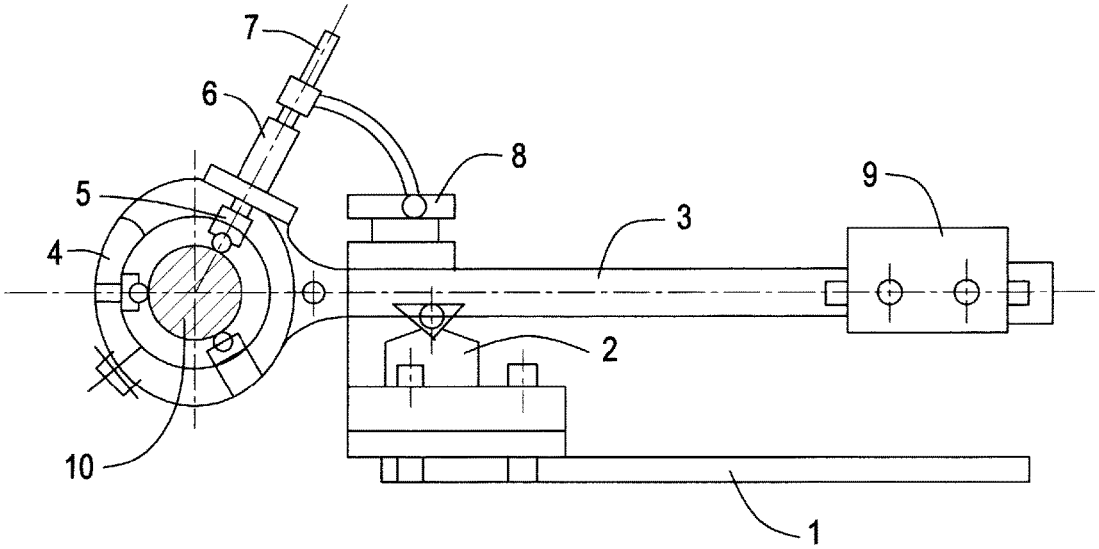
FIG. 1 illustrates an example closed containment frame for roller compression treatment of rotating shaft products.

Referring to FIG. 1, in closed containment frame arrangement, a set of compression roller cartridges 5 (three are illustrated in the example) are housed in a containment frame taking the form of a clamp 4. Each cartridge 5 contains roller(s) oriented to provide contact within the surfaces of the fillet radius 10 (or other work piece) at each end of one bearing journal. The containment frame 4 is constructed to affix onto a crankshaft 10 and is supported by a mounting plate 1. The mounting plate 1 is stationary but a trolley provides movement ability to link 3 such that the non-circular or asymmetric work piece 10 may rotate while roller cartridges 5 maintain contact therewith. A counterbalance weight 9 promotes stability to the assembly. A hydraulic pump 8 provides force to the work piece via a cylinder 6, e.g., via in-line compression of the roller cartridge indicated at 5. Thus, as work piece 10 rotates while the roller(s) maintain contact therewith via roller cartridges (e.g., 5) of clamp 4 being forced into contact with the work piece 10 via hydraulic pump 6.

This set up features a closed containment clamp 4 design but may impart significant compressive stress to the work piece, i.e., suitable for larger applications, as further described herein. This clamp 4 ensures contact of roller cartridges 5 with work piece 10. However, the asymmetric nature of the work piece 10 (e.g., crankshaft fillet) in turn causes containment clamp 4 to move (laterally), e.g., about trolley assembly 2. The overall assembly is also quite large and the mounting plate 1 remains stationary within a work environment (e.g., takes up committed floor space). Moreover, to insert and extract work piece 10 from containment clamp 4 of FIG. 1, one needs to physically disassemble the containment clamp 4, which tends to be difficult and at the very least time consuming, precluding anything approaching high throughput in terms of treating multiple work pieces 10 in rapid fashion. Furthermore, such a floor mounted assembly tends to preclude multiple clamps 4 from being attached to a work piece 10 at the same time.

Figure 2:
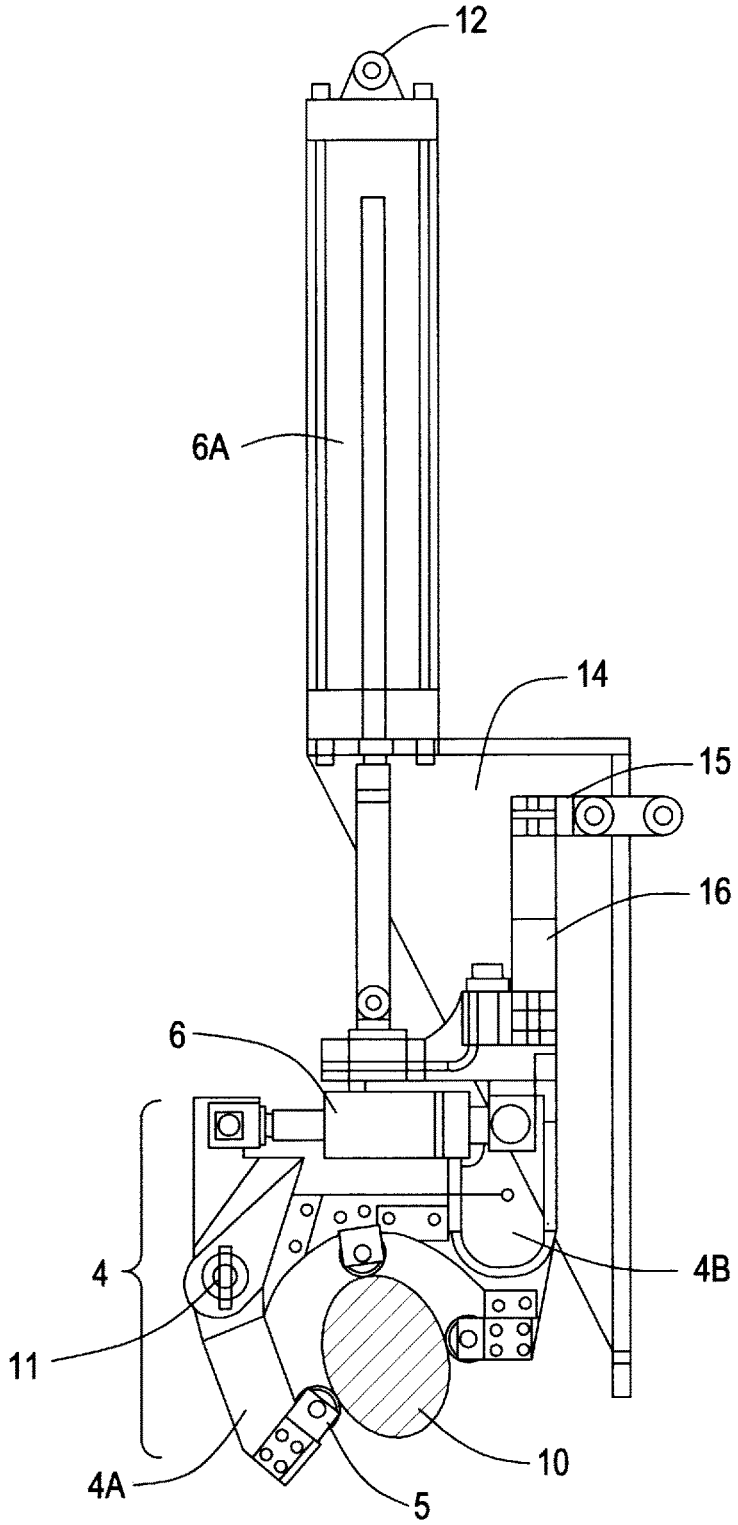
FIG. 2 illustrates an example open containment frame for roller compression treatment of rotating shaft products.

Referring to FIG. 2, an embodiment features an open containment frame arrangement whereby an opening is provided to a clamp 4. The example clamp 4 of FIG. 2 includes at least two parts 4A and 4B that move about one another, e.g., pivot about a point 11, such that the clamp 4 may be secured to the work piece 10 in a releasable fashion. Thus, in the example arrangement illustrated in FIG. 2, part 4A of clamp 4 may pivot about point 11 such that rollers 5 may contact and impart compressive stress to work piece 10 while providing treatment, but part 4A may also be released such that the work piece 10 may be taken out of the clamp 4 (or repositioned within the clamp 4) without disassembling the clamp 4. Movement of the arm 4A may be imparted by a hydraulic cylinder 6, as illustrated. This facilitates quicker insertion and removal of the work piece 10 and provides efficiency to the treatment process.

Stability of the overall assembly, e.g., as illustrated in FIG. 2, as opposed to fixing it to a location (e.g., floor secured mounting plate 1 shown in FIG. 1), is imparted via fixing various components against one another. This advantageously promotes stability while maintaining mobility of the overall unit. Thus, rather than fixing the entire unit in a stationary position, e.g., secured to the wall or the floor of a workspace, the entire unit may be suspended from a suspension element, e.g., via eyelet 12, such as from an overhanging crane unit. The entire unit therefore may be moved to different locations, e.g., to free up a portion of the work environment when assembly is not in use, or repositioned, e.g., to secure a work piece 10 therein more quickly.

Figure 4:
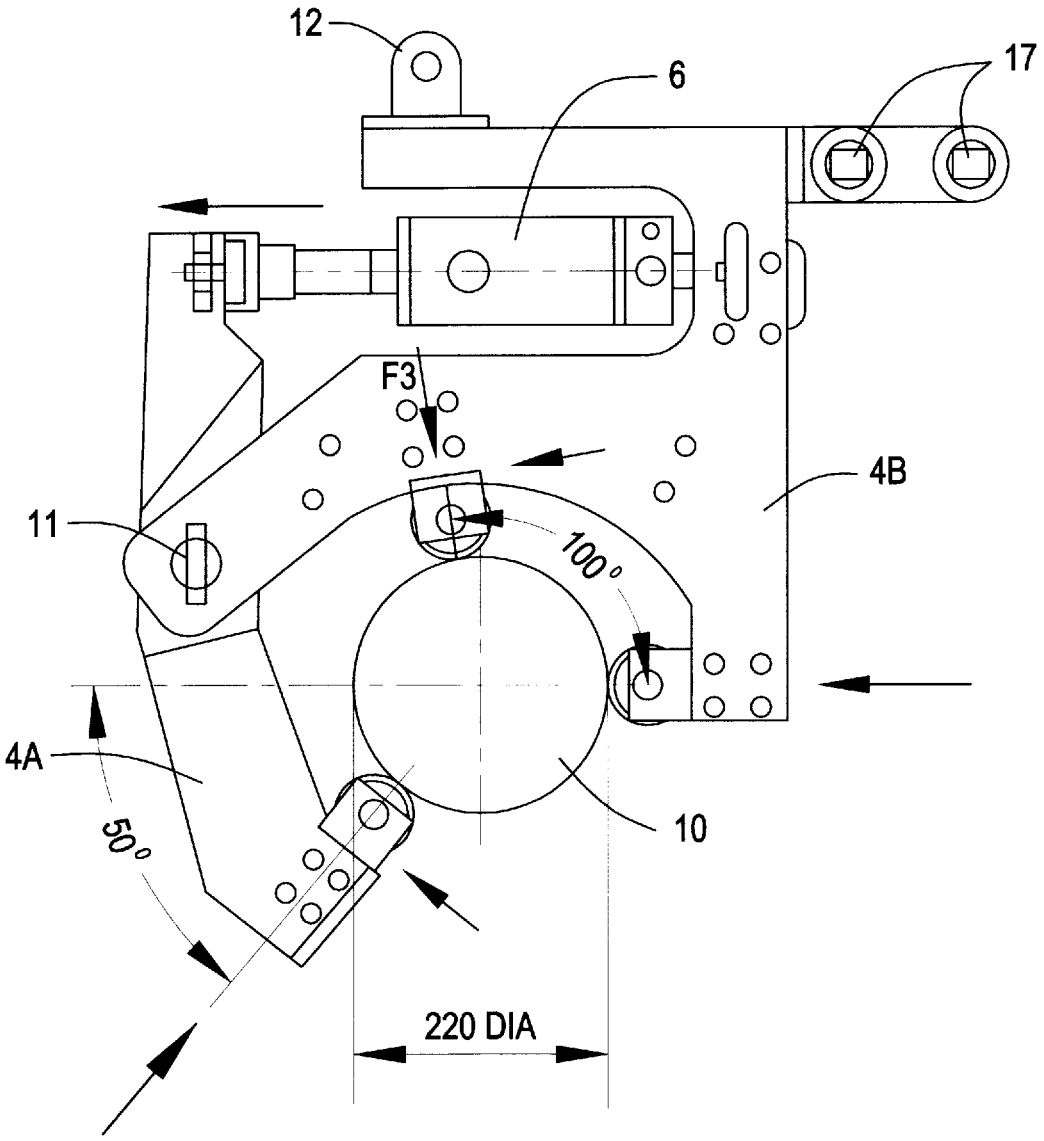
FIG. 4 illustrates another example open containment frame for roller compression treatment of rotating shaft products.

As may be appreciated from FIG. 2, the cylinder 6 provides movement of articulated arm portion 4A while main portion of the clamp 4B is in turn fixed relative to a bracket 14 (or like stability element, shown as transparent in FIG. 2 for ease of illustration) by an attachment 15. The attachment may take a variety of forms, e.g., having an arm portion 16 extending laterally from main portion 4B. Cylinder 6A for its part maintains force downward on main portion 4B such that clamp 4 is secured with respect to the bracket 14. For example, a main portion 4A of the containment frame 4 may be affixed to the bracket 14 such that the main portion 4A remains relatively stable with respect to the bracket 14 by virtue of forces imparted by the cylinders 6, 6A. As may be appreciated by those having skill in the art, other such arrangements may be utilized so long as the characteristics of stability and mobility of the assembly are maintained. One such alternative is illustrated in FIG. 4.

Figure 3:
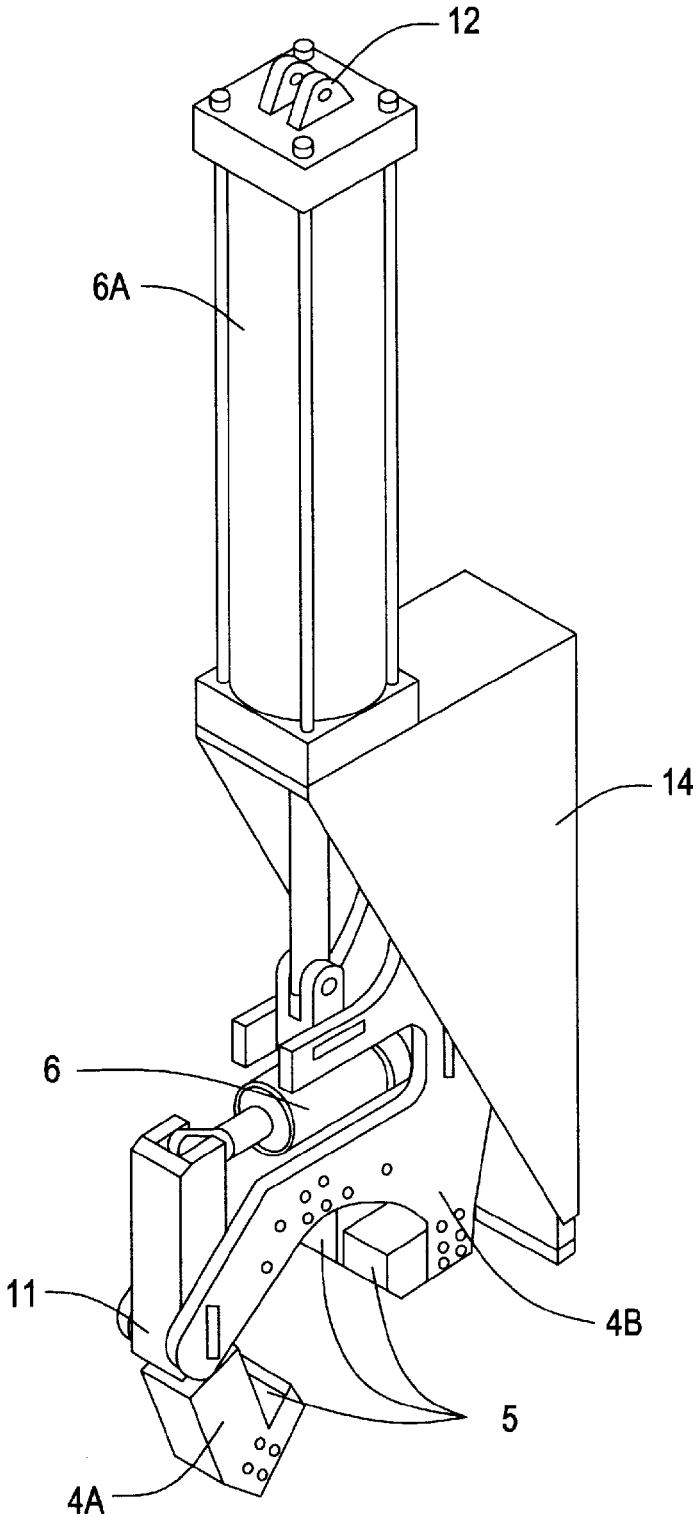
FIG. 3 illustrates a perspective view of an example open containment frame.

FIG. 3 illustrates a perspective view of the arrangement of FIG. 2, with the bracket 14 not being illustrated as transparent. The hydraulic cylinder(s) 6, 6A may serve multiple functions. Initially, the cylinder 6 permits displacement of one portion of the frame (e.g., 4A) to permit insertion of the work piece 10 (e.g., illustrated in FIG. 2). The cylinder 6 may than transition, e.g., via hydraulic pump, to enclose the work piece 10 and ensure contact of the rollers of cartridges, e.g., 5, with the work piece 10. Continued pressure at the hydraulic cylinder 6 provides an elevated normal force to be applied at all roller locations onto the work piece 10, e.g., crankshaft journal fillets.

Once the crankshaft or other work piece 10 is positioned within the containment frame 4 and normal force is existent between all rollers and crankshaft journal fillets 10, the crankshaft 10 may be rotated axially to permit travel of the rollers 5 along the circumferential surface of the journal fillets 10. The suspended assembly does not rotate as it is fixed, e.g., via attachment to an overhanging crane (not shown) via eyelet 12. The normal force of the rollers is incrementally increased over multiple rotations, e.g., via cylinder 6, to impart compressive residual stress into the journal fillet material 10.

Certain, e.g., two, of the cartridges may contain rollers of varying width profiles. One of the cartridges may contain rollers of parallel width profile. The function of the varying profile width is to provide alternating contact pressure onto the crankshaft fillet 10 as the surface is rotated across the roller 5. The function of the parallel width profile is to provide constant support to the crankshaft fillet 10 as the surface is rotated across the roller 5.

The open containment frame 4 configuration provides for scaling-up of the roller (burnishing) treatment to include rotating shaft products and crankshafts of various sizes, including work pieces 10 of much larger size than heretofore contemplated, e.g., up to 220 mm journal diameters or greater. Normal forces applied to the journal fillet surfaces may likewise be scaled up, e.g., in excess of 100 kN, and may be modified given the particular work piece 10, roller cartridges chosen, etc. This permits products of elevated mechanical property steels (e.g., quench and temper) and shafts of pre-conditioned surface hardening (e.g., via induction, nitride, carburized, and laser hardened) to receive improvement from this roller (burnishing) treatment.

Additionally, design of the open containment frame 4 as illustrated in FIG. 2 provides a pivoting movement of at least one compression roller cartridge, e.g., 5 (noting that more or fewer cartridges may be used than illustrated in the examples of the figures). This pivoting movement permits entry of the shaft work piece 10 into the assembly without the need for disassembly of retention hardware of the containment frame 4. As will be readily appreciated by those having skill in the art, this provides for quicker insertion, repositioning and removal of work pieces compared to arrangements such as illustrated in FIG. 1.

Furthermore, the configuration of the open containment frame 4 permits suspension of the treatment assembly from a vertical location above the shaft work piece 10, e.g., from eyelet 12. This assists, among other things, in entry, repositioning and removal of the work piece 10. This also permits multiple roller (burnishing) treatment devices to be affixed onto one shaft or work piece 10 at a time, allowing for simultaneous multiple treatments to be applied. The vertical suspension also permits the treatment assembly to remain effective to journal fillet locations that are not axially aligned with a crankshaft centerline ("pin" journals) during rotation of the work piece 10. That is, the assembly may move about the vertical attachment at eyelet 12 in multiple planes, rather than simply in one direction e.g., laterally, as with travelling trolley arrangement illustrated in FIG. 1. Again, the containment frame 4 does not rotate axially with the work piece 10 (which is in turn rotated, e.g., via a lathe (not shown)).

In an embodiment, the roller cartridges 5 may be interchanged to accommodate various work pieces 10. Thus, the clamp assembly is configured to interchangeably accommodate different roller cartridges 5 via cartridge attachments that permit replacement or fitment with alternate roller profiles and features. For example, fitment of impacting rods or profiled rams may be used to induce compressive residual stress into the journal fillet material 10. The assembly is thus modular and provides generation of normal force application onto the journal fillet locations 10 to affect compressive residual stress of material depths extending beyond 5 mm and to 7 mm of treatment depths below the journal surface. Thus, imparting compressive residual stress for larger work pieces 10 (e.g., marine and locomotive crank shafts) is possible with such an assembly.

FIG. 4 illustrates an alternate example. In FIG. 4, the cylinder 6A has been omitted and a single cylinder 6 is included. As illustrated, the claim assembly remains of the open configuration, with an articulating arm 4A that pivots about point 11 with respect to a main clamp portion 4B. The eyelet 12 (or other suitable attachment assembly) here is directly affixed to the main portion 4B, rather than to the top of the cylinder 6A as in FIG. 2 and FIG. 3. While the bracket has been omitted in FIG. 4, it will be appreciated that attachment 17 may provide for attachment of main portion 4B to a bracket (e.g., bracket 14) or like stabilizing element. The attachment 17, as illustrated, may include roller portions or like arrangement such that the main portion 4B may be secured at various positions to a bracket or like stabilizing element (not shown for ease of illustration).

From the foregoing it will be appreciated that various embodiments provide for a roller (burnishing) method applicable to medium-speed and high-speed diesel engine applications (e.g., marine, rail and power generation engine applications). The various assemblies, including an open type containment frame, allow for affixing of a rotatable shaft or other work piece into a supporting device capable of axial rotation of the crankshaft. The embodiments thus provide supporting devices with greater accessibility to the treatment surfaces (e.g., crankshaft journal surfaces) with improved mobility and throughput compared to other arrangements.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the specification there has been set forth example embodiments and, although specific terms are used, the description thus given uses terminology in a generic and descriptive sense only and not for purposes of limitation.

Finally, any numerical parameters set forth in the specification and claim(s) are approximations (for example, by using the term "about") that may vary depending upon the desired properties sought to be obtained by the embodiment(s). At the very least, each numerical parameter should at least be construed in light of the number of significant digits and by applying ordinary rounding.

What is claimed is:

1. A suspended supporting device for roller compression treatment of rotating shaft products, comprising:

a containment frame including:

a main portion;

an articulating arm including an attachment for a roller cartridge; and a roller cartridge attached to the attachment;

a support element attached to the main portion and providing internal stabilization to the supporting device;

a mechanism providing motion to the articulating arm with respect to a part of the main portion that is opposite to the roller of the articulating arm to impart compression treatment to a shaft positioned therebetween; and an attachment mechanism for suspending the suspended supporting device above ground via attachment to an overhanging external element.

2. The suspended supporting device of claim 1, wherein the external element comprises an overhanging crane unit having a vertical suspension element.

3. The suspended supporting device of claim 1, wherein the support element comprises a bracket element attached to the main portion and further wherein the support element includes the attachment mechanism.

4. The suspended supporting device of claim 1, wherein the attachment mechanism comprises an eyelet.

5. The suspended supporting device of claim 1, wherein the main portion includes an attachment for at least one roller cartridge.

6. The suspended supporting device of claim 1, wherein the main portion includes an attachment for at least two roller cartridges.

7. The suspended supporting device of claim 1, wherein the attachment for a roller cartridge is configured to attach a roller cartridge in releasable fashion.

8. The suspended supporting device of claim 7, wherein the main portion includes an attachment for at least one roller cartridge;

wherein the attachment for at least one roller cartridge of the main portion is configured to attach a roller cartridge in releasable fashion.

9. The suspended supporting device of claim 1, wherein at least one of the main portion and the articulating arm includes rollers of varying width profiles attached to attachments for roller cartridges.

10. The suspended supporting device of claim 1, wherein the main portion and the articulating arm are configured to permit insertion and retention of a work piece of at least 220 mm in diameter.

11. The suspended supporting device of claim 1, wherein the mechanism providing motion to the articulating arm with respect to the main portion comprises a hydraulic cylinder.

12. The suspended supporting device of claim 1, wherein the mechanism providing motion to the articulating arm with respect to the main portion comprises two or more hydraulic cylinders.

13. The suspended supporting device of claim 12, wherein the two or more hydraulic cylinders comprise:

a first hydraulic cylinder positioned to move an end of the articulating arm about a pivot point with respect to the main portion; and a second hydraulic cylinder positioned to move the main portion with respect to the support element.

14. The suspended supporting device of claim 13, wherein the support element comprises a bracket attached to the main portion.

15. A method for roller compression treatment of rotating shaft products using a suspended supporting device, comprising:

positioning a vertically suspended containment frame about a work piece, the containment frame including: a main portion; and an articulating arm including an attachment for a roller cartridge having one or more rollers attached thereto;

imparting compression force via the one or more rollers to the work piece via a mechanism providing motion to the articulating arm with respect to the main portion to impart compression treatment to a shaft positioned between the one or more rollers and the main portion; and rotating the work piece about a central axis;

wherein the vertically suspended containment frame does not rotate.

* * * * *